United States Patent [19]

Colville

[11] 4,307,522

[45] Dec. 29, 1981

[54] LAND GRADING MACHINE

[76] Inventor: Hume W. Colville, Murray St., Barham N.S.W., Australia, 2739

[21] Appl. No.: 132,343

[22] Filed: Mar. 20, 1980

[30] Foreign Application Priority Data

Mar. 21, 1979 [AU] Australia ..... PD8151
Nov. 21, 1979 [AU] Australia ..... PE1424

[51] Int. Cl.[3] ..... E02F 5/00

[52] U.S. Cl. ..... 37/7; 37/DIG. 1; 37/126 AD

[58] Field of Search ..... 37/7, 8, 126 R, 126 A, 37/126 AA, 126 AD, 124 R, DIG. 1, DIG. 3, DIG. 12, DIG. 13, DIG. 14, DIG. 15; 414/521, 528

[56] References Cited

U.S. PATENT DOCUMENTS

| | | | |
|---|---|---|---|
| 649,609 | 5/1900 | Layman | 37/7 X |
| 685,896 | 11/1901 | Wise | 37/7 |
| 827,457 | 7/1906 | Martin | 37/7 |
| 1,497,505 | 6/1924 | Guy et al. | 37/126 A X |
| 1,784,284 | 12/1930 | Guy et al. | 37/7 X |
| 2,577,877 | 12/1951 | Daniels | 37/126 R |
| 2,651,120 | 9/1953 | Miller | 37/7 |
| 2,755,092 | 7/1956 | Donahoe | 37/126 R X |
| 3,252,277 | 5/1966 | Welchel | 37/7 |
| 3,474,547 | 10/1969 | Campbell et al. | 37/8 |

*Primary Examiner*—E. H. Eickholt
*Attorney, Agent, or Firm*—Sughrue, Mion, Zinn, Macpeak & Seas

[57] ABSTRACT

A land grading machine comprising:

a frame having support means supporting the frame for movement in a forward direction across a ground surface;

a scraper blade for engaging the ground surface during such movement to effect grading by scraping ground material thereonto and therepast;

a conveyor positioned and arranged to receive and store ground material from the scraper blade and selectively operable to move so received material away from the scraper blade;

whereby when ground material builds up to a predetermined level on a part of the conveyor adjacent the blade, the conveyor can be moved to position a different part thereof adjacent to the scraper blade for reception of ground material.

20 Claims, 15 Drawing Figures

324
316
322
326
210
214
282
308
308b
308a
310
312
280
306
262
304
270
260
246
278
264
266
268
302

322
314
316
210
326
214
282
312
308b
308
308a
310
306
262
280
246
278
260
264

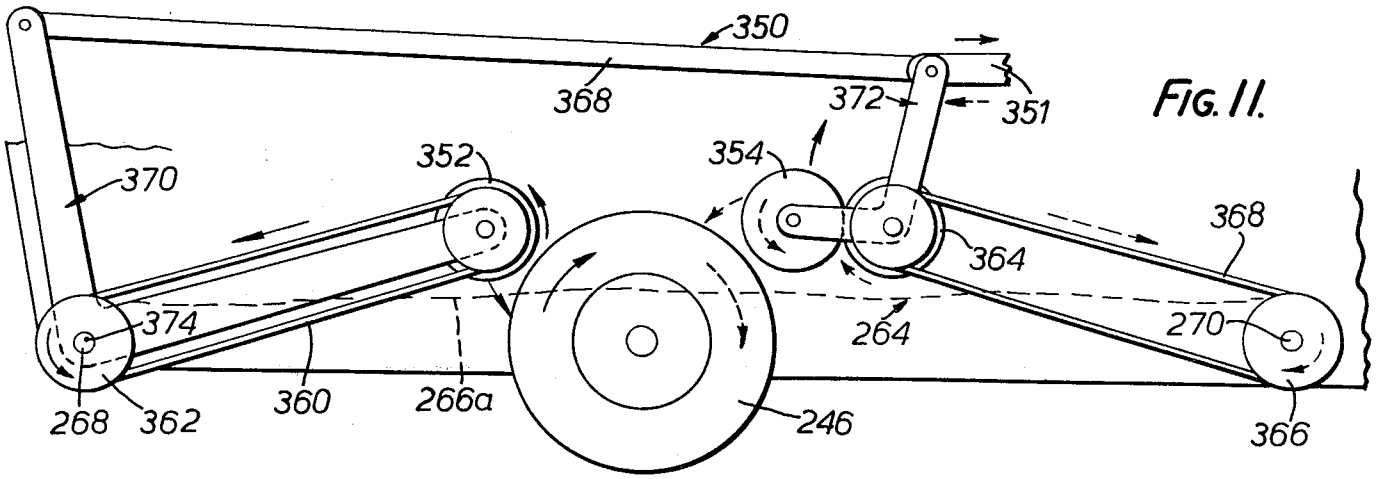
FIG. 11.
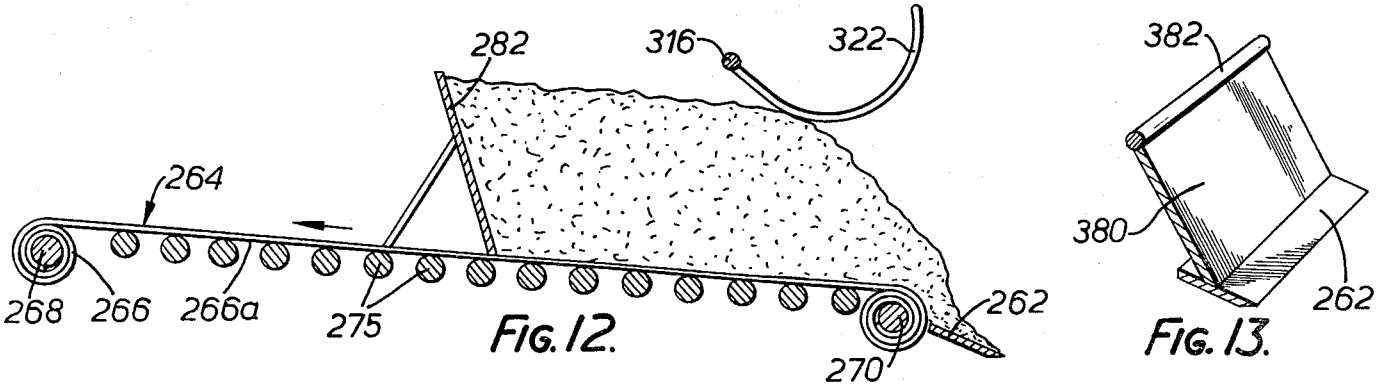
FIG. 12.
FIG. 13.

LAND GRADING MACHINE

BACKGROUND OF THE INVENTION

Field of the Invention

This invention relates to land grading machines.

BRIEF SUMMARY OF THE INVENTION

According to the invention there is provided a land grading maching comprising a frame having support means supporting the frame for movement in a forward direction across a ground surface;

a scraper blade for engaging the ground surface during such movement to effect grading by scraping ground material thereonto and therepast;

a conveyor positioned and arranged to receive and store ground material from the scraper blade and selectively operable to move so received material away from the scraper blade;

whereby when ground material builds up to a predetermined level on a part of the conveyor adjacent the blade, the conveyor can be moved to position a different part thereof adjacent to the scraper blade for reception of ground material.

The said support means normally comprise ground engaging wheels. The frame normally supports both the scraper blade and the said conveyor. Preferably, the machine is arranged so that the depth of cut of the scraper blade is variable. This may be effected by moving the scraper blade relative to the frame, but preferably is effected by forming the frame in two parts, a first part carrying the said scraper blade and conveyor and having ground wheels, said first part being pivotally secured towards the forward end thereof to a second part of the frame which extends forwardly thereof, adjustable means being provided for varying the pivotal relationship between the first and second parts to raise and lower the forward end of the first frame part and to correspondingly raise and lower the scraper balde.

Preferably control means is provided including sensing means for sensing the heights of the ground material build-up above the scraper blade and a motor for driving the conveyor, said control means in use operating said motor for driving the conveyor to move material in a rearward direction away from the scraper blade whenever the build-up reaches a first predetermined level.

The control means is preferably further capable of controlling the conveyor to drive the conveyor to move in a forward direction to move material thereon towards the scraper blade whenever the level of material on the conveyor falls below a second predetermined level lower than said first level, and to maintain the conveyor stationary when the material level is intermediate said first and second levels.

Preferably the conveyor is an endless conveyor belt which is arranged for driving by a motor and which is positioned to extend between opposed lengthwise extending retaining side walls of the frame. The conveyor may have an upstanding transverse wall arranged to prevent egress of the material from the rear end thereof. In this case, at the beginning of grading, the transverse wall may be positioned immediately behind the scraper blade and selectively moved rearwardly as grading progresses.

In the described preferred arrangement using the two part frame, this frame is preferably so arranged as to permit the scraper blade to be positioned at a location well clear of the ground surface, at which condition the upper surface of the conveyor immediately behind the scraper blade assumes a substantially horizontal condition for transport of material on the conveyor by moving the machine. A roller may be provided rotatably mounted on the frame in the vicinity of the scraper blade and arranged to engage the ground surface of a location immediately forward of the scraper blade for assisting in movement of ground surface material onto and over the scraper blade.

The roller may engage the ground surface at its periphery or may be provided with numerous projecting elongate elements around its outer surface for such engagement. In either event the drum may be rotated by virtue of its contact with the ground surface or may be rotated by a motor.

According to another aspect of the present invention there is provided a land grading machine comprising a frame having support means supporting the frame for movement in a forward direction across a ground surface;

a forwardly located scraper blade for engaging the ground surface during such movement to effect grading by scraping ground material thereonto and therepast; and a conveyor positioned and arranged to receive and store ground material from the scraper blade and selectively operable to move so received material away from the scraper blade whereby when ground material builds up to a predetermined level on a part of the conveyor adjacent the blade, the conveyor can be moved to position a different part thereof adjacent to the scraper blade for reception of ground material;

said support means comprising ground wheels at least one being positioned to either side of said frame intermediate the lengthwise locations of the scraper blade and rear of the conveyor.

The frame normally supports both the scraper blade and the said conveyor. Preferably, the machine is arranged to that the depth of cut of the scraper blade is variable. This may be effected by moving the scraper blade relative to the frame, but preferably is effected by forming the frame in two parts.

Preferably means is provided for sensing the level of the ground material build-up above the scraper blade and to operate a motor for driving the conveyor to move material away from the scraper blade whenever the build-up reaches a first predetermined level.

The control means is preferably further capable of controlling the conveyor to drive the conveyor to move in a forward direction to move material thereon towards the scraper blade whenever the level of material on the conveyor falls below a second predetermined level lower than said first level, and to maintain the conveyor stationary when the material level is intermediate said first and second levels.

Preferably the conveyor is positioned to extend between opposed lengthwise extending retaining side walls of the frame. The conveyor may have an upstanding transverse wall arranged to prevent egress of the material from the rear end thereof. In this case, at the beginning of grading, the transverse wall may be positioned immediately behind the scraper blade and selectively moved rearwardly as grading progresses.

In the described preferred arrangement using the two part frame, this frame is preferably so arranged as to permit the scraper blade to be positioned at a location well clear of the ground surface at which condition the upper surface of the conveyor immediately behind the scraper blade assumes a substantially horizontal condition for transport of material on the conveyor by moving the machine.

According to another aspect of the present invention there is provided a land grading machine comprising a frame having ground wheels supporting the frame for forward movement across a ground surface;

a scraper blade for engaging the ground surface during such movement to effect grading by scraping ground material thereonto and therepast;

a conveyor positioned and arranged to recieve and store ground material from the scraper blade and selectively operable to move so received material away from the scraper blade whereby when ground material builds up to a predetermined level on a part of the conveyor adjacent the blade, movement of the conveyor can be effected to position a different part thereof adjacent to the scraper blade for reception of ground material; and drive means for effecting said movement of said conveyor, said drive means comprising a disengageable coupling which when engaged is operated by rotation of one or more of said ground wheels pursuant to movement of the grading machine across siad ground surface. Preferably the drive means is controlled by a control means including sensing means arranged to sense the level of the ground material build-up above the scraper blade and to engage said coupling for driving the conveyor to move material in a rearward direction away from the scraper blade whenever the build-up reaches a first predetermined level.

The control means is preferably further capable of engaging the coupling to drive the conveyor to move in a forward direction to move material thereon towards the scraper blade whenever the level of material on the conveyor falls below a second predetermined level lower than said first level, and to disengage the coupling when the material level is intermediate said first and second levels.

The conveyor may comprise a conveyor belt which extends between end rollers such as to be moved in said rearward direction by driving a first said roller in a first direction via said coupling when engaged in a first mode and in said forward direction by driving one said roller in one direction via said coupling when engaged in a second mode.

Said coupling may include first and second endless belts engagable to be driven by said one or more ground wheels during the said movement of said grading machine over said ground surface. In one embodiment, said endless belts each run over respective pairs of end rollers and said sensing means operates to selectively engage respective ones of two idler rollers with said one or more ground wheels for driving of the selected idler roller frictionally from said one or more ground wheels, said idler rollers being connected to transfer rotation thereof for driving said endless belts. In another embodiment, said first and second endless belts run around associated respective pairs of end rollers and one end roller of each pair is arranged to be selectively driven from said one or more ground wheels during movement of the grading machine over said ground surface, said belts being arranged to be in a slack condition when said coupling is disengaged, whereby no driving of the one end rollers of the belts occurs pursuant to rotation of said one or more ground wheels, and said belts being each selectively conditionable to a tensioned condition at which frictional driving of the associated said one end roller occurs, so that said coupling is then engaged in said first or second mode depending upon which of said endless belts is so conditioned in the tensioned condition.

Alternatively, said coupling may comprise a first flexible elongate element which is arranged to be wound onto a first drum by rotation of the or each said ground wheel or wheels when said coupling is engaged in said first mode, and a second elongate flexible element which is arranged to be wound on to the said first or another said first drum when said coupling is engaged in said second mode. Ends of the flexible elongate elements remote from the associated first drum or drums may be wound around further respective drums for transferring rotation of the or each first drum to selected ones of the said further drums when the said coupling is engaged. In this instance, clutch means is preferably provided between the or each first drum and said one or more ground wheels whereby said coupling is engaged in said first mode by clutching one said first drum for rotation transfer from a said one or more ground wheels and said coupling is engaged in said second mode by clutching the other said first drum for driving from a said one or more ground wheels.

Said conveyor may be an endless conveyor belt although I prefer to form the conveyor as a length of flexible material ends of which are wound around its end rollers and secured thereto.

In accordance with the still further aspect of the present invention there is provided a land grading machine comprising a frame having support means supporting the frame for movement in a forward direction across a ground surface;

a scraper blade for engaging the ground surface during such movement to effect grading by scraping ground material thereonto and therepast;

a conveyor positioned and arranged to receive and store ground material from the scraper blade and selectively operable to move so received material away from the scraper blade whereby when ground material builds up to a predetermined level on a part of the conveyor adjacent the blade, the conveyor can be moved to position a different part thereof adjacent to the scraper blade for reception of ground material; and a glide plate extending above said scraper blade in the side to side direction of the machine and pivotal about a side to side axis at a location above the scraper blade and normally resting against the upper surface of the scraper blade so as to present an upstanding surface for build up of ground material thereagainst.

BRIEF DESCRIPTION OF THE DRAWINGS

The invention is further described by way of example with reference to the accompanying drawings in which

FIG. 11 is a side view of a further form of drive means which may be incorporated into the machine of FIG. 5; and FIG. 12 is a lengthwise cross-sectional view of the machine of FIG. 5 showing a loading condition thereof;

FIG. 13 is a fragmentary perspective view showing an optional modification of the machines of FIGS. 1 to 12;

DETAILED DESCRIPTION

Figure 1:
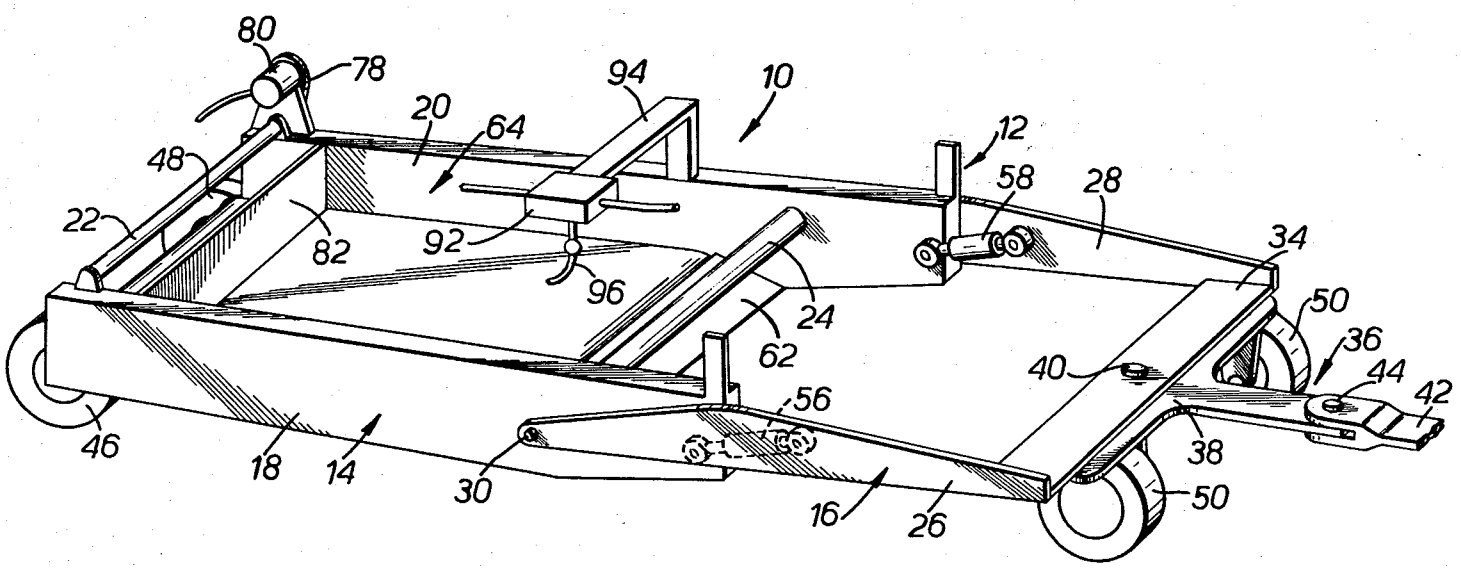
FIG. 1 is a perspective view of a grading machine constructed in accordance with the invention.
Figure 2:
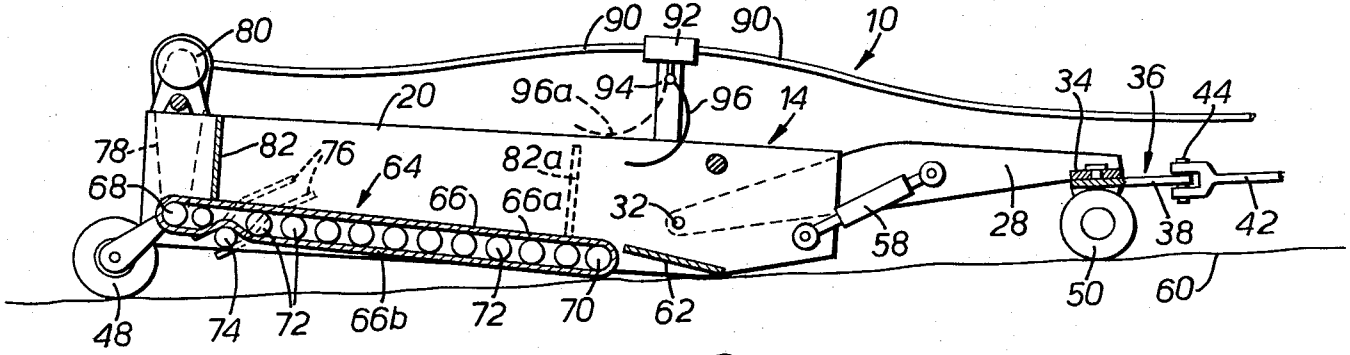
FIG. 2 is a lengthwise vertical cross-section of the machine of FIG. 1.

The grading machine 10 shown in FIGS. 1 and 2 includes a frame 12 having a first part 14 and a second part 16. The first part 14 comprises two opposed side walls 18,20 which extend lengthwise of the machine and which are held in rigid spaced apart location by a number of side to side support members of which only two, indicated by reference numerals 22,24 are shown. Frame part 16 comprises two spaced apart members 26, 28 which are pivoted to respective walls 18, 20, towards the front thereof, by pivot pins 30, 32. From the pivot pins 30, 32, the members 26, 28 extend forwardly to a rigid cross-bar 34 which interconnects these and extends transversely of the machine. A towing turntable 36 is provided at the forward end of the machine. This comprises a tow plate 38 mounted below crossbar 34 and mounted thereto for pivotal movement about a vertical axis by means of a pivot pin 40. A tow plate 38 extends forwardly from pivot pin 40 and is arranged to permit securement to tractor towbar 42, such as by means of a pivot pin 44 extending through the towbar and tow plate.

Frame 12 is arranged for movement across a ground surface, being supported at its rear end by ground wheels 46, 48 on frame part 14 and at its forward end by ground wheels 50, 52 mounted to tow plate 38.

Frame parts 14, 16 are interconnected by two hydraulic rams 56, 58. Ram 56 is pivotally connected at one end to member 26 and at the other end to side wall 18. Ram 58 is, likewise, pivotally connected at one end to member 28 and at the other end to side wall 20. By adjusting the effective lengths of the rams 56, 58 it is possible to vary the pivotal disposition of the frame parts 14, 16 about the common axis of the pins 30, 32. By this means, the forward end of the frame part 14 can be moved in a manner which causes it to be raised or lowered relative to the ground surface 60 over which the frame is moved.

Frame part 14 carries a transverse planar scraper blade 62 which is secured at one end to wall 18 and at the other end to wall 20. A conveyor 64 is also carried by frame part 14, being positioned immediately behind blade 62. This comprises a wide endless flexible conveyor belt 66 extending across the width of the machine between the walls 18, 20 and arranged to run about transverse end rollers 68, 70. Rollers 68, 70 are mounted for free rotation on axes extending transversely between walls 18, 20. The conveyor belt 66 presents an upper run **66*a* extending between rollers 68, 70 which extends from a location immediately behind and level with the rear edge of blade 62 to the rear of the frame part 14. This upper run 66*a* is support on a number of transversely extending freely rotatable support rollers 72. A further transversely extending freely rotatable roller 74 is mounted on inclined guideways 76 on walls 18, 20 to bear against the underside run 66*b* of conveyor belt 66 and arranged to be adjustably positioned along the lengths of guideways 76** to adjust the tension in the belt.

Roller 68 is coupled via an endless chain 78 to a hydraulic motor 80 so that when the motor is operated, the chain is driven by rotating a sprocket (not shown) attached to the output shaft of the motor so that the chain drives a further sprocket bracket (not shown) attached to the roller 68. By appropriately controlling the motor 80 it is possible to drive the conveyor such that the belt run **66*a*** is advanced either in the front to rear direction of the machine or the rear to front direction.

Conveyor belt 66 carries an upstanding transversely extending wall member 82. This extends vertically upwardly from conveyor run **66*a* to about the upper height of the side walls 20, 18** and provides a transversely extending barrier extending between the side walls of the machine.

A hydraulic line 90 which supplies hydraulic fluid to motor 80 for operating the motor passes through a control device 92. Device 92 is supported from frame part 14 by a support member 94 such that it is positioned above the top edge of the walls 18, 20 and substantially directly above blade 62. Device 92 is electrically actuatable and includes hydraulic valves and an actuating lever 96 which hangingly depends from the device to a lower end positioned at a location just below the upper edges of the walls 18, 20 and about above the forward end of the conveyor run **66*a*. When the lever 96 is pivoted in the clockwise direction as shown in FIG. 2, such as to the position shown in broken lines and indicated by reference numeral 96*a*, device 92 is operated to effect operation of motor 80 to drive conveyor 66 so that the upper run 66*a* is driven in the rearward direction. When the lever 96 is positioned in its normal condition as shown in solid lines in FIG. 2 the motor 80 is operated to drive the conveyor so that run 66*a* moves in the forward direction. At positions of lever 96 between these two positions motor 80** is not operated and the conveyor is stationary.

In use of the grading machine, it is attached as aforedescribed to the tow bar of a tractor for towing across the ground surface 60. The hydraulic rams 56, 58 are adjusted so as to bring the forward edge of the cutting blade 62 to a desired location such that during such towing across the ground surface, high spots are removed to a desired extent by scraping of material on to the scraper blade 62. As shown, the scraper blade is inclined at a relatively small angle to the ground surface during this operation so that scraped material is moved by virtue of the forward movement of the machine along the upper surface of the scraper blade. During this action, a certain part of the removed material will also move off the rear end of the scraper blade towards the forward end of the conveyor belt run **66*a*. It will be recalled that conveyor 80 is operated, when lever 96 is in its lower condition as shown in FIG. 2, to drive the conveyor run 66*a* forwardly. Initially then, during grading the lever 96 assumes this lower condition and the conveyor run 66***a* is so driven forwardly as to tend to prevent material from moving across the scraper blade onto the conveyor. By this means there is assured a good build up of removed material on the top of the scraper balde. As material build up occurs, it will eventually reach a height at which it bears against the underside of lever 96 and pivots it in the clockwise direction but not to an extent which moves it to the position 96*a*. Thus, motor 80 ceases running and conveyor run 66*a* is stationary. Then, as more material is removed by blade 62, material will begin to move across the blade and onto the forward end of conveyor run 66*a*. Usually, the build up of material on the scraper blade will be such that the removed material forms a mound extending from the forward edge of the scraper blade to a maximum height roughtly adjacent the forward end of the conveyor belt 66 and thence on to the forward end portion of the conveyor run 66*a*. Roughly, then, about half of the removed material will be on the scraper blade and about half on the forward portion of the conveyor run 66*a*. When the material is built up to a desired height, it will so press against the underside or lower end of the lever 96 as to press it further upwardly and rearwardly so that it reaches the position shown by broken lines 96*a*, where upon device 92 will actuate the motor to move the conveyor run 66*a* rearwardly until the height of material beneath the lever 96 is such as to allow the lever 96 to revert to its intermediate position whereupon the motor is switched off and the conveyor 64 stops operation. The effect of this is that, as the material is removed, it is passed onto the conveyor and gradually moved backwards each time there is a sufficient build-up on the front end of the conveyor belt run 66*a*. If by some means, the material build up should fall to a level sufficient to cause lever 96 to revert completely to its downwardly depending position, motor 80 will also be automatically engaged to cause run 66*a* to move forwardly to restore even build-up on the conveyor. In normal operation, the grading operation is begun with the wall member 82 positioned well forward on the conveyor 64 such as at the location shown in broken lines 82*a* in FIG. 2.

When the conveyor 64 has been so operated as to move it to the position shown in solid lines in FIG. 2, that is to say to the rear of the frame part 14, substantially the whole of the space between the walls 18, 20 and forwardly of the wall member 82 to the front of the conveyor will be filled to substantially the full height of the walls 18, 20. At the completion of such filling, the motor 80 is stopped when a full load is positioned on the conveyor, such as by engagement of a suitable load sensor (not shown) on frame part 14 by the wall member 82, the load sensor being arranged, however, such that it is not effective to stop motor 80 when lever 96 is in its lower position. The motor can then be disabled by an override control (not shown) which takes precedence over control by device 92 and the load sensor (and which can, conveniently, be arranged on the towing tractor). The rams 56, 58 can then be operated to lift the forward end of frame part 14 so that the blade 62 is lifted clear of the ground surface 60 and the conveyor 64 is moved so that the upper run 66*a* is shifted from the somewhat inclined position of FIG. 2 to a position at which it is more nearly horizontal. In this condition, the material stored on the conveyor can be easily transported by towing of the machine 10. In this process, a certain amount of material will be lost off the front portion at least of the blade 62, but in fact this loss is not significant.

To unload material the override control is cancelled and the machine towed across the surface where unloading is to be effected, with rams, 56, 58 adjusted so that the scraper blade just clears the ground surface. Because of the material loss off the scraper blade which occurs at the beginning of the material transport, the lever 96 will, in the meantime, have assumed its lower position, so that motor 80 is engaged upon cancelling the override control to drive the conveyor so that material on run 66*a* is advanced forwardly over the scraper blade 62 to fall over the forward edge and be deposited evenly over the ground surface. During such movement, if substantial build up of material at the location of the lever 96 occurs, the forward movement of conveyor run 66*a* will be stopped by virtue of pivoting of lever 96, until this build up is cleared so that a finely controlled even deposit of material is achieved.

The described apparatus has the particular advantage that it has a relatively great storage capacity but does not require powerful prime movers in order to effect adequate operation thereof. Again, it is relatively simple in construction and is consequently relatively inexpensive to construct. The machine is particularly adaptable to automatic operation where the grading height is controlled by appropriate levelling means such as by use of a level laser beam, the machine in this instance being fitted with means for sensing such laser beam and actuating the rams 56, 58 in a manner such that the height of material removed by the blade 62 is adjusted in accordance with the requirements necessary to secure levelling over a wide area.

Figure 4:
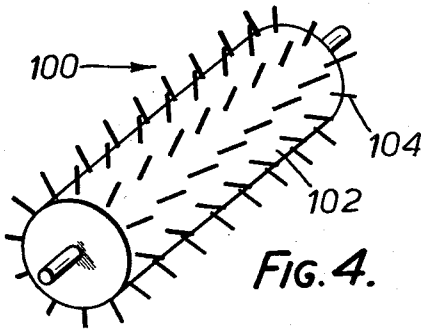
FIG. 4 is a perspective view of a roller incorporated into the modified machine of FIG. 3.
Figure 3:
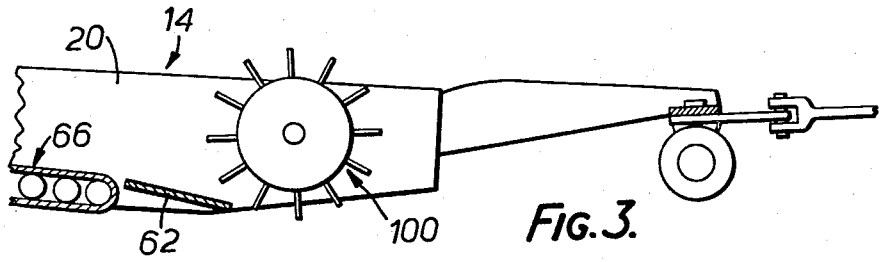
FIG. 3 is a scrap view corresponding to part of FIG. 2 but showing a modification to the machine of FIGS. 1 and 2.

FIGS. 3 and 4 show a modification of the machine of FIGS. 1 and 2. Here, in order to assist in moving material onto the scraper blade during grading, the machine is provided with a roller device 100. This is in the form of a drum 102 mounted for free rotation on frame part 14 and extending transversely between walls 18, 20 immediately in front of blade 62. Drum 102 has numerous radial fingers 104 and the drum is positioned so that tips of these engage the ground surface to effect rotation of the drum during grading. The fingers 104 may, however, be omitted and the drum periphery arranged for engagement with the ground surface to effect such rotation. The device 100 also may be arranged to be driven by a motor rather than by virtue of ground surface engagement during grading.

Figure 5:
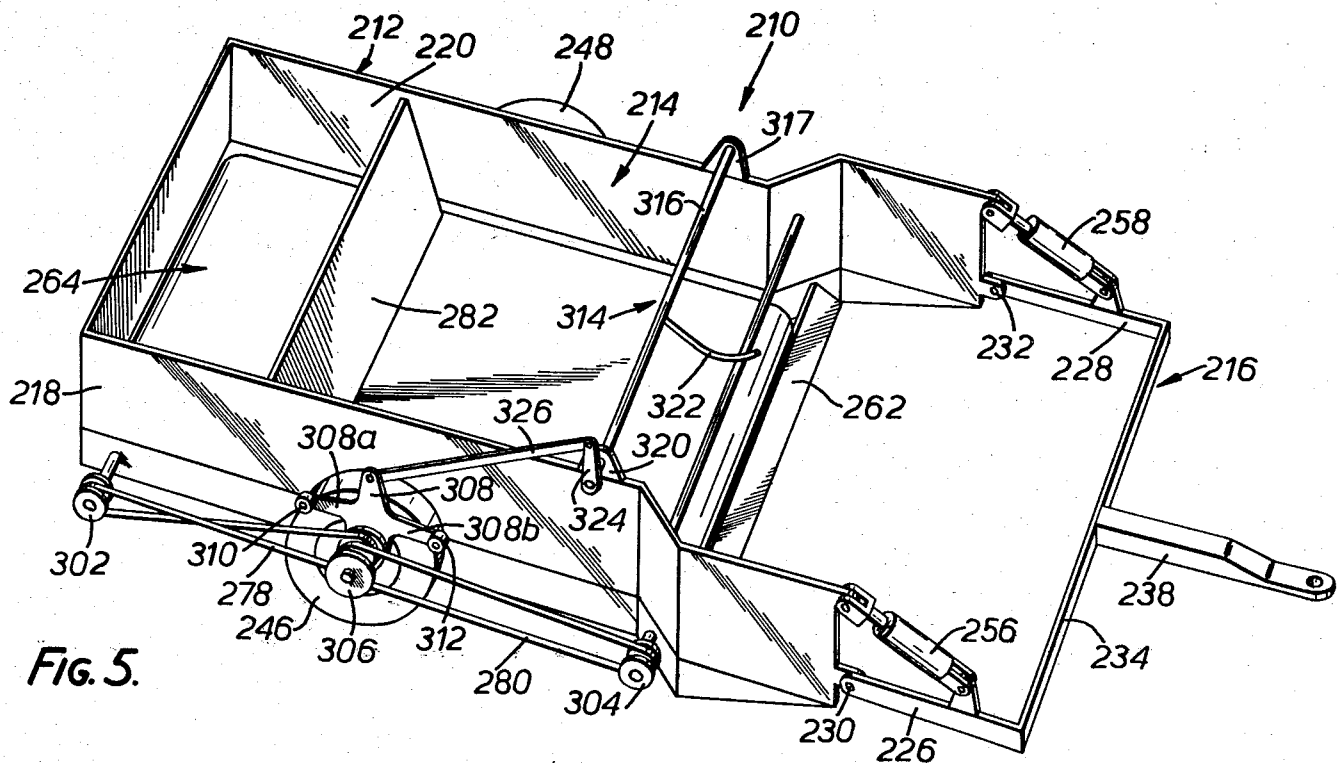
FIG. 5 is a perspective view of a further form of grading machine constructed in accordance with the invention.
Figure 6:
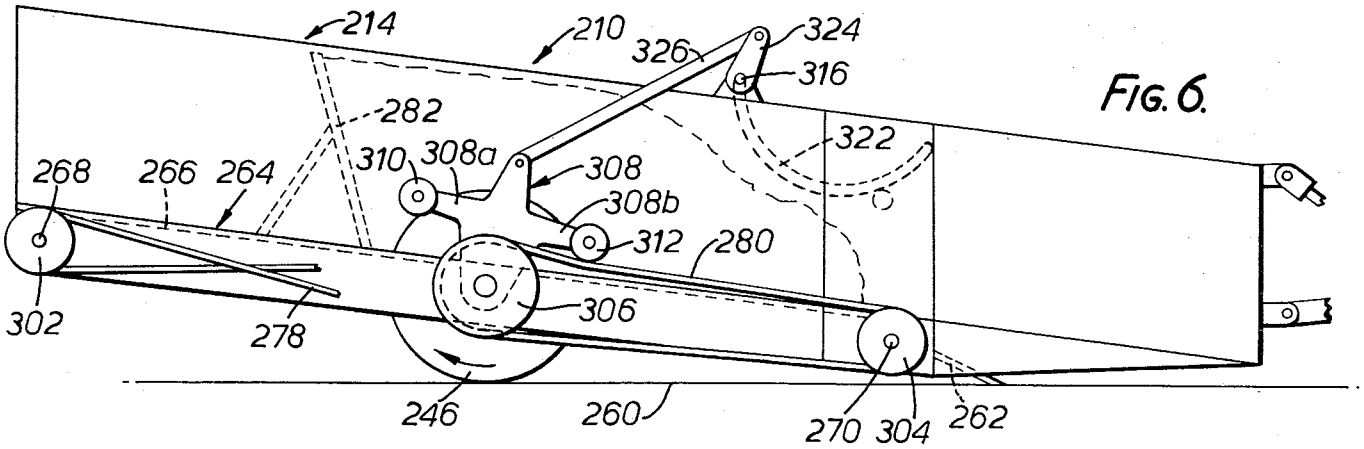
FIG. 6 is a side view of the machine of FIG. 5.
Figure 7:
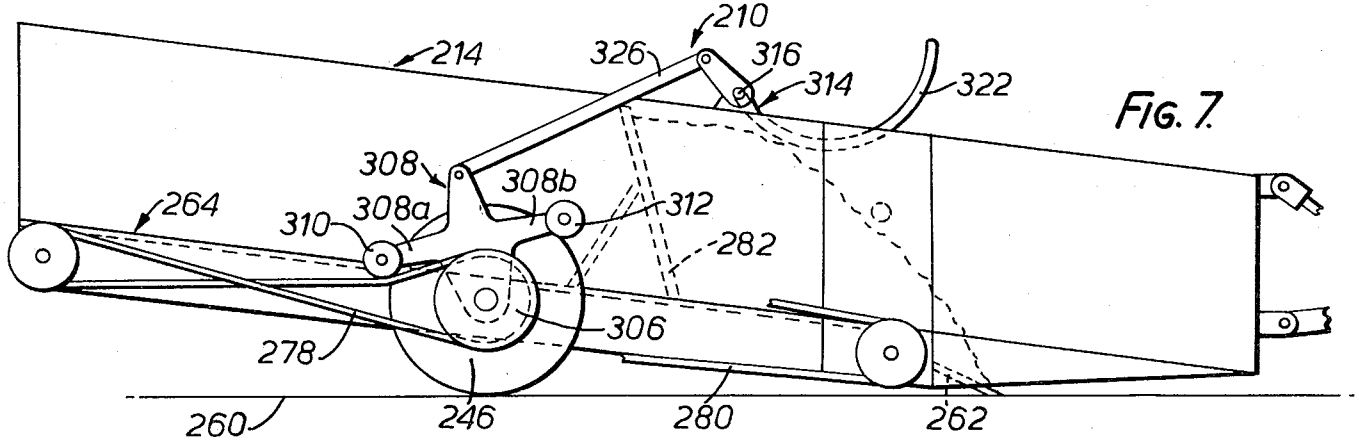
FIG. 7 is a side view like FIG. 6 but showing the machine in a different condition.

The grading machine 210 shown in FIGS. 5 to 7 includes a frame 212 having a first part 214 and a second part 216. The first part 214 has two opposed side walls 218,220 which extend lengthwise of the machine and which are in spaced apart relationship. Frame part 216 comprises two spaced apart members 226, 228 which are pivoted to respective walls 218, 220, towards the front thereof, by pivot pins 230, 232. From the pivot pins 230, 232, the members 226, 228 extend forwardly to a rigid cross-bar 234 which interconnects there and extends transversely of the machine. A tow bar 238 extends forwardly from cross bar 234 and is arranged to permit securement to a tractor towbar.

Frame 212 is arranged for movement across a ground surface, being supported at its sides by ground wheels 246,248. These are positioned about half way between the front and rear ends of the frame part 214.

Frame parts 214, 216 are interconnected by two hydraulic rams 256, 258. Ram 256 is pivotally connected at one end to member 226 and at the other end to side wall 218. Ram 258 is pivotally connected at one end to member 228 and at the other end to side wall 220. By adjusting the effective lengths of the rams 256, 258 it is possible to vary the pivotal disposition of the frame parts 214, 216 about the common axis of the pins 230, 232. By this means, the forward end of the frame part 214 can be moved in a manner which causes it to be raised or lowered relative to the ground surface 260 over which the frame is moved.

Frame 214 carries a transverse planar scraper blade 262 which is secured at one end to wall 218 and at the other end to wall 220. A conveyor 264 is also carried by frame part 214, being positioned immediately behind blade 262. This may be in the form shown in FIG. 6, comprising a wide endless flexible conveyor belt 266 extending across the width of the machine between the walls 218 and 220 and arranged to run about transverse end rollers 268, 270. Rollers 268, 270 are mounted for free rotation on axes extending transversely between walls 218, 220. The conveyor belt 266 is wound at each end around the rollers 268, 270 and is secured to these rollers so as to present a conveyor run 266*a* extending between rollers 268, 270 from a location immediately behind and level with the rear edge of blade 262 to the rear of the frame part 214. This run 266*a* is supported on a number of transversely extending freely rotatable support rollers 275 (FIG. 12).

Rollers 268, 270 are coupled via endless belts 278, 280 for driving the conveyor belt in a manner described later such that the belt run 266*a* is advanced either in the front to rear direction of the machine or in the rear to front direction.

Conveyor belt 266 carries an upstanding transversely extending wall member 282. This extends vertically upwardly from conveyor run 266*a* to about the upper height of the side walls 220, 218 and provides a transversely extending barrier extending between the side walls.

Rollers 268, 270 extend through side wall 218 of frame part 214 and have wheels 302, 304, co-axially secured thereto. A drum 306 is co-axially carried by one ground wheel 246. Endless belt 280 extends around drum 306 and wheel 304 and endless belt 278 extends around drum 306 and wheel 302. The belts 278, 280 are, however, relatively loose so that, normally, there is insufficient frictional coupling between the belts 278, 280 and drum 306 to impart drive from the drum to the belts. However, a tensioning device 308 is provided operable to tension either belt 278, 280 selectively for driving coupling between the so selected belt and drum 306. Tensioning device 308 comprises a lever which is co-axially mounted relative to wheel 246 and drum 306 and such as to be freely rotatable about such axis. Device 308 has two oppositely directed side arms 308*a*, 308*b*. These each carry separate idler wheels 310, 312. By pivoting device 308 about the axis of wheel 246 and drum 306, the device can be brought to the position shown in FIG. 7 where idler wheel 310 bears against one run of endless belt 278 so pressing this downwardly and tensioning the belt. Analagously, by pivoting device 308 in the opposite direction, to the position shown in FIG. 6, idler wheel 312 can be brought to bear against endless belt 280 for tensioning this belt. At the intermediate position, shown in FIG. 5, neither idler wheel 310, 312 engages its respective belt 278, 280.

Control of the engagement of driving connection from wheel 246 via drum 306 and either belt 278 or 280 to the respective associated wheel 302 or 304 is controlled by a sensor device generally designated by reference 314. Sensor device 314 includes an elongate shaft 316 which extends transversely of the machine 210, being mounted for rotation in bearings 317, 320, on walls 220, 218 of the frame part 214. Shaft 316 is positioned well above and a short distance behind blade 262. A sensor arm 322 extends forwardly from shaft 316. Arm 322 is of generally curved form, extending downwardly from shaft 316 to a lowermost portion and thence upwardly again.

A crank arm 324 is connected to one end of shaft 316 so as to extend radially therefrom. The free end of crank arm 324 is pivotally connected to one end of a connecting rod 326, the other end of this connecting rod being pivotally coupled to device 308, at a location spaced away from the axis of turning thereof. The arrangement is thus such that when the sensor arm 322 is at a lowermost location, as represented in FIG. 6, the shaft 316 is correspondingly turned in a clockwise direction so as to draw connecting rod 326 forwardly and thence to pull on device 308 so as to effect turning thereof to engage idler wheel 312 with belt 280, so engaging driving connection from drum 306 to wheel 304. When sensor arm 322 is moved from the position shown in FIG. 6 in the anti-clockwise direction to an upper location as shown in FIG. 7, shaft 316 is correspondingly turned in the counter-clockwise direction so that connecting rod 326 pushes against device 308 to turn it in the counter-clockwise direction to cause idler wheel 310 to engage endless belt 278 for driving interconnection between drum 306 and wheel 302.

It will be noted that when ground wheel 246 is driven in the clockwise direction as viewed in FIGS. 6 and 7, as occurs under forward movement of the machine 210, (i.e. movement from left to right as shown in FIGS. 6 and 7) and belt 280 is being driven, the direction of rotation of wheel 304 is the same as that of ground wheel 246, since the belt 280 extends directly around the drum 306 and wheel 304. In this case, then, the conveyor 264 is operated so that belt 266 is wound onto end roller 270 so moving the run 266*a* of the belt in the direction from the rear towards the front of the machine 210. On the other hand, when belt 278 is operative under clockwise rotation of ground wheel 246, wheel 302 is driven in the counter clockwise direction thus also driving roller 268 in the counter clockwise direction. In this instance, then, belt 266 is wound up on end roller 268, thus driving conveyor run 266*a* in the forward to rearward direction of the machine 210. The counter clockwise direction of rotation of wheel 302 under this circumstance occurs because the belt 278, instead of passing directly around the drum 306 and wheel 302 is twisted so that the two runs thereof extending between the wheel 302 and drum 306 cross each other.

In use of the grading machine, it is attached as aforedescribed to the tow bar of a tractor for towing across the ground surface 260. The hydraulic rams 256, 258 are adjusted so as to bring the forward edge of the cutting blade 262 to a desired location such that during such towing across the ground surface, high spots are removed to a desired extent by scraping of material on to the scraper blade 262. As shown, the scraper blade is inclined at a relatively small angle to the ground surface during this operation so that scraped material is moved by virtue of the forward movement of the machine along the upper surface of the scraper blade. During this action, a certain part of the removed material will also move off the rear end of the scraper blade towards the forward end of the conveyor belt run 266*a*. It will be recalled that when sensor arm 322 is in its lower condition as shown in FIG. 6, there is a driving connection from ground wheel 246 such that, under forward movement of the machine 210, the conveyor run 266*a* is run forwardly. Initially then, during grading the sensor arm assumes its lower condition and the conveyor run 266*a* is so driven forwardly as to tend to prevent material from moving across the scraper blade onto the conveyor. By this means there is assured a good build-up of removed material on the top of the scraper blade. As material build up occurs, it will eventially reach a height at which the material bears against the underside of sensor arm 322 and pivots the arm in the counterclockwise direction to the position shown in FIG. 5. Thus, drive to conveyor 264 ceases and conveyor run 266*a* is stationary. Then, as more material is removed by blade 262 material will begin to move across the blade and onto the forward end of conveyor run 266*a*. Usually, the build up of material on the scraper blade will be such that the removed material forms a mound extending from the forward edge of the scraper blade to a maximum height roughly adjacent the forward end of the conveyor belt 266 and thence on to the forward end portion of the conveyor run 266*a*. Roughly, then, about half of the removed material will be on the scraper blade and about half of the forward portion of the conveyor run 266*a*. When the material is built up to a desired height, it will so press against the underside or lower end of sensor arm 322 to press the sensor arm further upwardly and forwardly so that it reaches the position shown in FIG. 7, whereupon driving coupling is established to move the conveyor run 266*a* in the rearward direction until the height of material beneath the sensor arm 322 is such as to allow the sensor arm to revert to its intermediate position (FIG. 5) whereupon the conveyor 264 stops operation. The effect of this is that, as the material is removed, it is passed onto the conveyor and gradually moved backwards each time there is a sufficient build-up on the front end of the conveyor belt run 266*a* (FIG. 12). If by some means, the material build-up should fall to a level sufficient to cause sensor arm 322 to revert completely to its downwardly depending position, drive will also be automatically engaged to cause run 266*a* to move forwardly to restore even build-up on the conveyor.

In normal operation, the grading operation is begun with the wall member 282 positioned well forward on the conveyor 264. When the conveyor 264 has been so operated as to move the conveyor belt 266 to the rear of the frame part 214 substantially the whole of the space between the walls 218,220 and forwardly of the wall member 282 to the front of the conveyor will be filled to substantially the full height of the walls 218,220. Means (not shown) is provided for disengaging driving connection from ground wheel 246 to conveyor 264 when a full load is positioned on the conveyor. This may comprise a suitable load sensor (not shown) on frame part 214 and which is engaged by the wall member 282 when in its rearmost position, the load sensor being arranged, however, such that it is not effective to disengage drive if arm 322 is in its lower position. Further means (also not shown) is provided to permit selective disabling of such drive when filling is completed to a desired extent. This means may comprise an override control which takes precedence over control by sensor arm 322 and the load sensor (and which can, conveniently, be arranged on the towing tractor). After operation is stopped by the override control, the rams 256,258 can then be operated to lift the forward end of the frame part 214 so that the blade 262 is lifted clear of the ground surface 260 and the conveyor 264 is moved so that the upper run 266*a* is shifted from the somewhat inclined position shown in FIGS. 6 and 7 to a position at which it is more nearly horizontal. In this condition, the material stored on the conveyor can be easily transported by towing of the machine 210. In this process, a certain amount of material will be lost off the front portion at least of the blade 262, but in fact this loss is not significant.

To unload material the override control is cancelled and the machine towed across the surface where unloading is to be effected, with rams 256,258 adjusted so that the scraper blade just clears the ground surface. Because of the material loss off the scraper blade which occurs at the beginning of material transport, the sensor arm 322 will, in the meantime, have assumed its lower position, so that drive to the conveyor 264 is engaged, upon cancelling the override control, to drive the conveyor so that material on run 266*a* is advanced forwardly and deposited evenly over the ground surface. During such movement, if substantial build-up of material at the location of the sensor arm 322 occurs, the forward movement of conveyor run 266*a* will be stopped by virtue of pivoting of sensor arm 322 until this build up is cleared so that a finely controlled even deposit of material is achieved.

Figure 8:
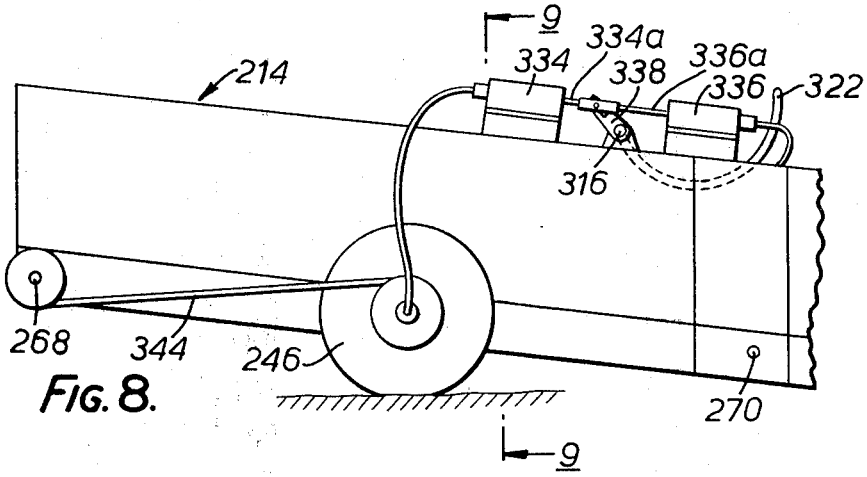
FIG. 8 is a fragmentary side view showing an alternative form of machine constructed in accordance with the invention.
Figure 9:
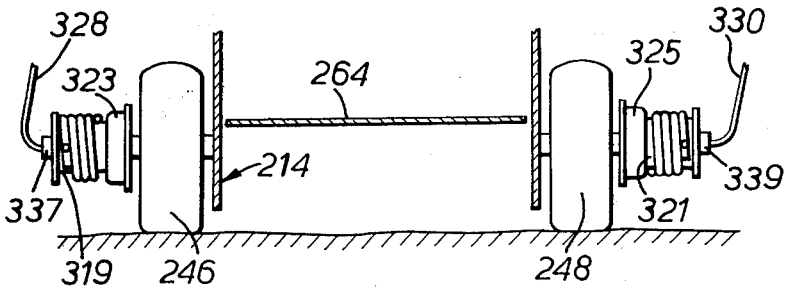
FIG. 9 is a fragmentary cross-section on the line 9—9 in FIG. 8.

The modified construction shown in FIGS. 8 and 9 differs from that shown in FIGS. 5 to 7 only in that the conveyor 264 is arranged differently for driving. More particularly, in this instance, the conveyor end rollers 268,270 are arranged for driving from respective ones of the ground wheels 246,248. Ground wheel 246 has a co-axially mounted drum 319 so arranged as to be selectively clutchable to the axle of wheel 246. Similarly, a drum 321 is co-axially mounted relative to wheel 248 and is selectively clutchable to the axle of this wheel. This clutching is effected by hydraulic clutches 323, 325 respectively connected by respective hydraulic lines 328, 330 to two control valves 334, 336 mounted on frame part 214. In this instance, the sensor arm 322 is arranged to turn shaft 316 in the same way as previously described in relation to the arrangement of FIGS. 5 to 7 under influence of loaded material in the machine. Here, however, shaft 316 carries a crank arm 338 which is pivotally connected at a location eccentric relative to the axis of shaft 316 so as to effect movement of actuating members 334*a*, 336*a* of the valves 334, 336 so as, on the one hand, to apply pressurized hydraulic fluid from a source (not shown) through valve 334 to clutch 323 (in a condition shown in FIG. 4 where the sensor arm 322 is at its uppermost position) and, on the other hand, to operate valve 336 to apply pressurized hydraulic fluid from the pressurised source to clutch 325 (when the sensor arm is in its lowermost position, not shown). Again, there is an intermediate position of the arm 322 at which neither valve 334, 336 is operated and no hydraulic pressure is applied to the lines 328, 330 and neither clutch 323 or 325 is operated.

Figure 10:
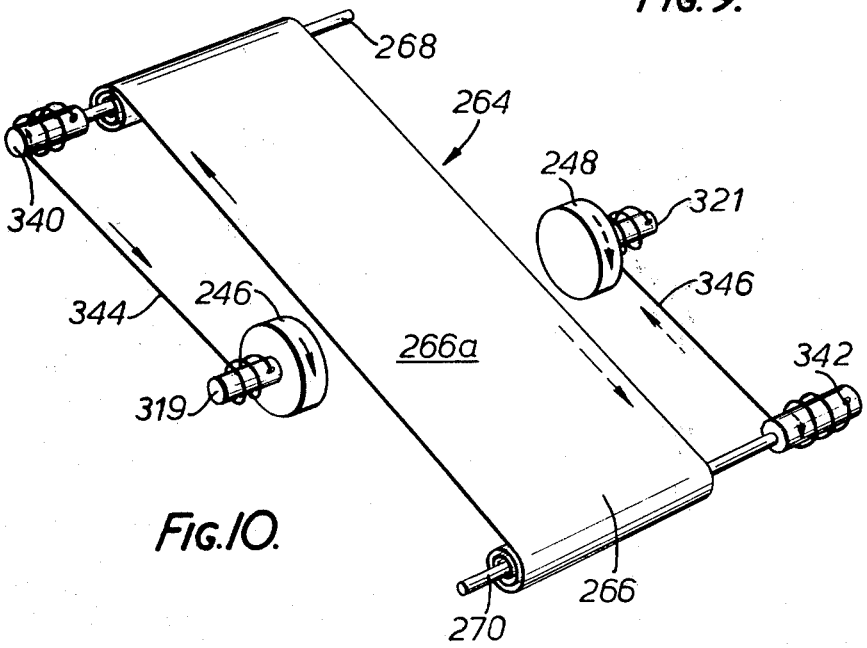
FIG. 10 is a diagrammatic perspective view of the machine of FIG. 8.

As best illustrated in FIG. 10, end roller 268 carries a drum 340 which is affixed co-axially thereto and end roller 270 carries a drum 342 which is co-axially affixed to end roller 270. A length of cable 344 is affixed to a point on the periphery of drum 319, wound around the drum and thence extends rearwardly to drum 340 where it is wound around the drum 340 and affixed to a point on the periphery of the drum 340. Analagously, a length of cable 346 is affixed to a point on the periphery of drum 321, wound around the drum 321 and thence extends forwardly to drum 342 where it is wound around the drum and affixed at its extremity to a point on the periphery of drum 342.

In operation of the embodiment of FIGS. 8 to 10 under forward movement of the machine, rotation of ground wheels 246,248 can be selectively transferred to drums 319, 321 by operation of the clutches 323, 325. Thus, in the condition where there is little material below sensor arm 322, the sensor arm will drop, operating valve 336 thus actuating clutch 325 to couple drum 321 for rotation with wheel 248. In this case, cable 346 is wound onto drum 321 and unwound from drum 342 with a consequent rotation of drum 342 thereby driving conveyor 264 such that conveyor belt 266 is advanced. Conversely, when sensor arm 322 is moved upwardly under influence of material therebelow, valve 334 is operated to effect operation of clutch 323 so that drum 319 is rotated pursuant to rotation of wheel 246. Then, cable 344 is wound up on drum 319 and unwound from drum 340 causing consequent rotation of end roller 268 in a manner causing the conveyor run **266*a*** to be moved in the rearward direction.

At an intermediate position of sensor arm 322, neither valve 334, 336 is operated and the conveyor 264 is not operated.

In order to permit rotation of the drums 319, 321, the hydraulic lines 328, 330 are connected to the clutches 323, 325 via rotary couplings 337, 339.

The embodiment of FIG. 11 is also analagous to that shown in FIG. 4 and, in this case, the sensor arm 322 is coupled to a linked frame 350 so constructed as to permit selective engagement of either one of two idler rollers 352, 354 with the periphery of wheel 246. More particularly, when the arm 322 is in its raised position, frame 350 is moved to cause idler wheel 352 to be brought into engagement with wheel 246. The sensor arm 322 is connected to frame 350 via a link 351 described later. Idler wheel 352 is interconnected via an endless belt 360 with a wheel 362 secured to end roller 268 so that when idler wheel 352 is rotated, belt 360 is moved to turn end roller 268 via wheel 362 to cause belt run **266*a* to move in the forward to rearward direction. On the other hand, idler wheel 354 is arranged to frictionally drive a further wheel 364 which is drivingly interconnected with a wheel 366 via an endless belt 368. Wheel 368 is connected to end roller 270 for rotation therewith. Thus, when idler wheel 354 is engaged with the periphery of wheel 246 and is turned, consequent turning of wheel 364 occurs and driving of wheel 366 also occurs via belt 368. In this instance, then, end roller 270 is driven in a manner such as to cause belt run 266*a* to be moved in the rearward to forward direction. In order to be effective for generating the necessary movements of idler wheels 352 and 354, the frame 350 is comprised of three members, a link 368 connected at its opposite ends to two L-shaped levers 370, 372. Lever 370 has two arms the first of which is pivotly connected to link 368 and the second of which carries the idler wheel 252. Lever 370 is pivotal about a fixed pivot 374 aligned with the axis of wheel 362. Lever 372 is pivotal about a fixed pivot aligned with the axis of wheel 364 and has one arm pivotally connected to link 368 and another arm which carries at its extremity the idler wheel 354**.

The link 351 which connects to frame 350 is coupled to the junction between line 368 and lever 372 and is connected, at the end opposite thereto, to a crank arm connected to shaft 316 from which sensor arm 322 depends in the manner described in previous embodiments. Thus when the sensor arm 322 is at its upper most position link 351 is moved in the forward direction to engage idler wheel 352 and when in its lower position, the link 351 is moved rearwardly to engage idler wheel 354.

FIG. 13 illustrates a modification of the invention and is applicable to each of the three described embodiments. More particularly, a glide plate 380 is provided which extends transversely across frame part 214 between side walls 218 and to 220 and is pivotally mounted so as to depend from a transverse axle 382 freely rotatable relative to the frame part 214. This glide plate rests against scaper blade 262 so that material scraped from the ground surface by scraper blade 262 builds up against the glide plate 380. The glide plate is made of material having high surface finish and the smoothness of this plate permits the ready build up of material thereon such that material tends to rise to a higher height above the scraper blade than would be the case if the plate were not there. Glide plate 380 is so arranged, however, that material having built up to a desired height can pass over the top edge thereof and onto the conveyor 284. The hinged arrangement provided by the pivotable mounting of the shaft 382 permits the plate 380 to swing forwardly so that material can be discharged therepast during off-loading from the machine.

The described arrangements of FIGS. 5 to 13 have been found to be particularly satisfactory. It should be noted in this respect that the positioning of the wheels of the machine to either side of the frame 212 and at an intermediate location along the length thereof is advantageous in limiting the adverse effects of torsional twisting of the frame about the length-wise direction thereof as may occur during grading operations. Such twisting permits build up of vibration which, under influence of heavy loads such as are normally carried by the machine when in use, causes up and down undulating movements of the machine resulting in uneven grading.

It will be further observed that the width of the blade 262 exceeds the side to side width between the extreme outer edges of the wheels 246, 248. Thus, during grading, the wheels always run over ground surface which has been graded by the scraper blades.

In the drawings of the embodiment of FIG. 5, the idler wheel 310 is shown, for purposes of clarity, as being so arranged as to press on the uppermost run of belt 278. In practice, however, satisfactory operation will normally require that this idler wheel be positioned to engage the upper side of the lower run of the belt 278 adjacent drum 306.

Figure 14:
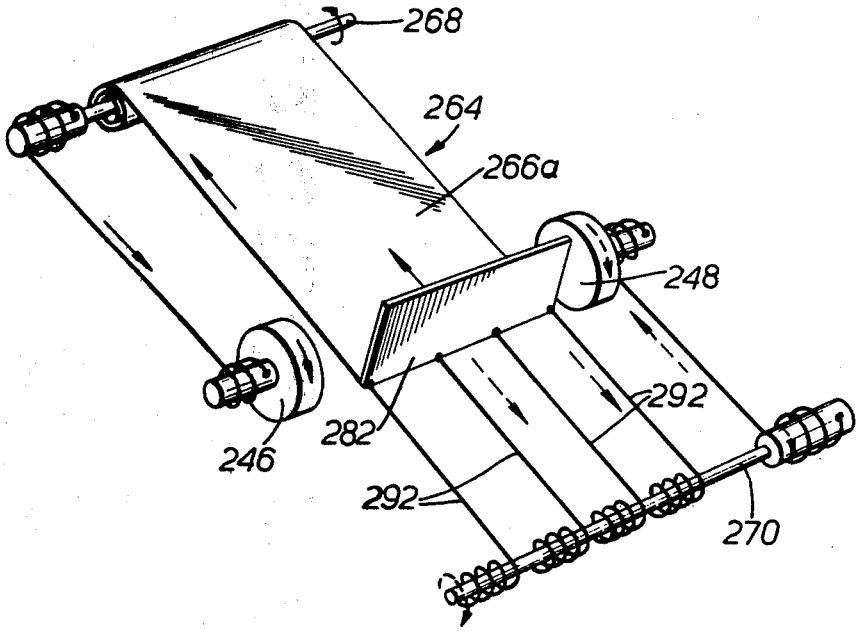
FIG. 14 is a view like FIG. 10, but showing a modification of the machine of FIG. 8.

The described method of forming the conveyor belt 266 from flexible metal sheet may of course be varied. In particular in the modification of FIG. 14, that part of the belt extending behind the wall member 282 is replaced by a number of transversely spaced cables 292. Again, a rubber belt can be employed.

Figure 15:
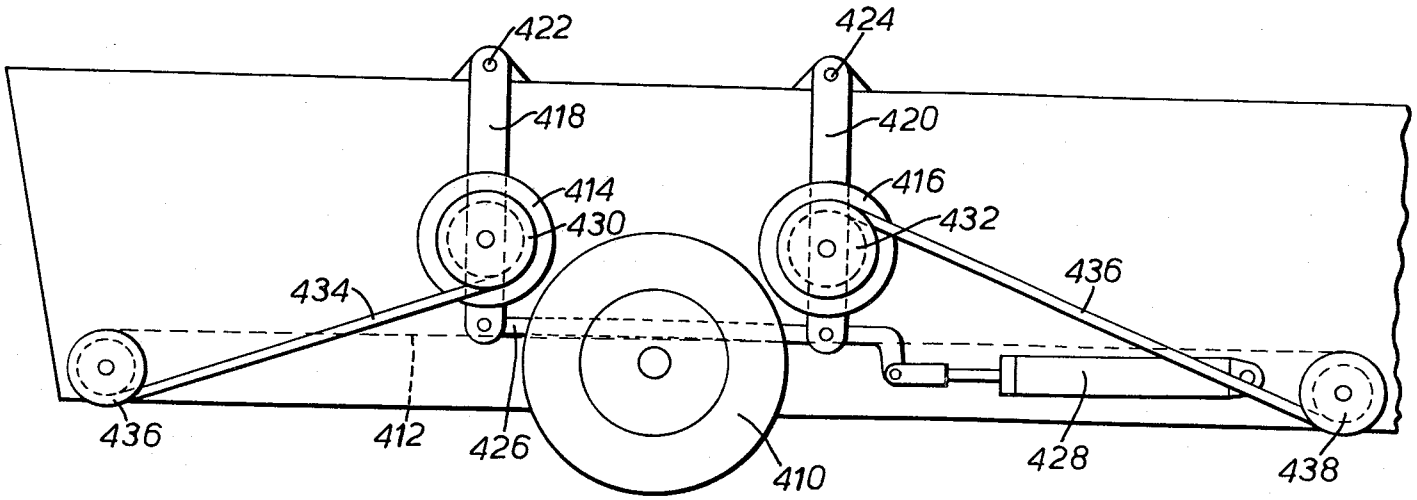
FIG. 15 is a diagrammatic side view of a still further machine constructed in accordance with the invention.

The arrangement of FIG. 15 is like the arrangement of FIG. 11 in that drive from one ground wheel 410 to the conveyor 412 is selectively achieved by engaging either of two jockey wheels 414, 416 to frictionally engage the periphery of wheel 410. The wheels 414, 416 are freely rotatable on links 418, 420 which depend from upper pivot pins 422, 424 on the frame of the machine. Lower ends of the links 418, 420 are pivotally interconnected by a link 426 connected to a hydraulic ram 428. Ram 428 is pivotally connected at one end to the machine frame and at the other end to link 426. The ram 428 is selectively extensible to effect driving from either jockey wheel 414, 416 by moving links 418, 420. The wheels 414, 416 carry drums 430, 432 and cables 434, 436 are wound at one end around and connected to these drums. The other ends of the cables are wound around drums 436, 438 coaxially mounted relative to drums which support opposite ends of the conveyor belt 412 and around which the opposite ends of the conveyor belt are wound and secured.

I claim:

1. A land grading machine comprising:

a frame having support means supporting the frame for movement in a forward direction across a ground surface;

a scraper blade for engaging the ground surface during said movement to effect grading by scraping ground material thereonto and therepast;

a movable conveyor positioned and arranged to receive and store ground material from the scraper blade;

control means including sensing means for sensing the height of accumulated scraped ground material; and drive means for driving the conveyor;

said control means controlling said drive means to cause the drive means to drive the conveyor to move ground material thereon in a rearward direction away from the scraper blade whenever the height of said accumulated scraped ground material reaches a first predetermined level as sensed by said sensing means, said control means also controlling said drive means to cause the drive means to drive the conveyor to move ground material thereon in a forward direction towards the scraper blade whenever the height of said accumulated scraped ground material falls below a second predetermined level as sensed by said sensing means, said second predetermined level being lower than said first predetermined level, and to maintain the conveyor stationary when the height of said accumulated scraped ground material is sensed by said sensing means to be intermediate said first and second levels.

2. A land grading machine as claimed in claim 1, wherein said frame is formed in two parts, a first part carrying the said scraper blade and conveyor and having ground wheels forming at least part of said support means, said first part being pivotally secured towards the forward end thereof to a second part of the frame which extends forwardly of the first part, adjustable means being provided for varying the pivotal relationship between the first and second parts to raise and lower the forward end of the first frame part and to correspondingly raise and lower the scraper blade.

3. A land grading machine as claimed in claim 1, wherein said drive means includes a motor and said sensing means comprises a lever mounted for pivotal movement above said conveyor so as to be engaged and pivoted upwardly by said accumulated scraped ground material at least when the height of said accumulated scraped ground material exceeds said second predetermined level, said control means controlling said motor in response to pivoting of said lever.

4. A land grading machine as claimed in claim 1, wherein said conveyor is in the form of an elongate belt and extends between opposed lengthwise extending side walls of the frame, and said conveyor has an upstanding transverse wall arranged to prevent egress of the ground material on the conveyor belt from the rear end thereof, arranged so that at the beginning of grading, the transverse wall may be positioned immediately behind the scraper blade and selectively moved rearwardly as grading progresses.

5. A land grading machine as claimed in claim 1, wherein said frame is so arranged as to permit the scraper blade to be positioned at a location well clear of the ground surface, at which condition the upper surface of the conveyor immediately behind the scraper blade assumes a substantially horizontal condition for transport of material on the conveyor by moving the machine.

6. A land grading machine as claimed in claim 1, including a roller rotatably mounted on the frame in the vicinity of the scraper blade and arranged to engage the ground surface at a location immediately forward of the scraper blade for assisting in movement of ground material onto and over the scraper blade.

7. A land grading machine as claimed in claim 1, including a glide plate extending above said scraper blade in the side-to-side direction of the machine and pivotal about a side-to-side axis at a location above the scraper blade and normally resting against the upper surface of the scraper blade so as to present an upstanding surface for build-up of said accumulated scraped ground material thereagainst.

8. A land grading machine as claimed in claim 6, wherein said roller is arranged for engagement with the ground surface for frictional driving of the roller.

9. A land grading machine as claimed in claim 6, wherein means is provided for rotating said roller.

10. A land grading machine as claimed in claim 1, wherein said support means comprises ground wheels, at least one being positioned to either side of said frame intermediate the lengthwise locations of the scraper blade and rear of the conveyor.

11. A land grading machine as claimed in claim 1, wherein said support means includes ground wheel means comprising one or more ground wheels and said drive means comprises a disengageable coupling which when engaged is operated by rotation of said ground wheel means pursuant to movement of the grading machine across said ground surface.

12. A land grading machine as claimed in claim 11, wherein said conveyor comprises a conveyor belt which extends between end rollers such as to be moved in said rearward direction by driving a first said end roller in a first direction via said coupling when engaged in a first mode and in said forward direction by driving one said end roller in one direction via said coupling when engaged in a second mode.

13. A land grading machine as claimed in claim 11, wherein said coupling includes first and second endless belts engageable to be driven by said ground wheel means during the said movement of said grading machine over said ground surface.

14. A land grading machine as claimed in claim 13, wherein said endless belts each run over respective pairs of end rollers and said control means operates to selectively engage respective ones of two idler rollers with said ground wheel means for driving of the selected idler roller frictionally from said ground wheel means, said idler rollers being connected to transfer rotation thereof for driving said endless belts.

15. A land grading machine as claimed in claim 13, wherein said first and second endless belts run around associated respective pairs of end rollers and one end roller of each pair is arranged to be selectively driven from said ground wheel means during movement of the grading machine over said ground surface, said belts being arranged to be in a slack condition when said coupling is disengaged, whereby no driving of the one end rollers of the belts occurs pursuant to rotation of said ground wheel means, and said belts being each selectively conditionable when the coupling is engaged to a tensioned condition at which frictional driving of the associated said one end roller occurs, so that said coupling is then engaged in said first or second mode depending upon which of said endless belts is so conditioned in the tensioned condition.

16. A land grading machine as claimed in claim 12, wherein said coupling comprises a first flexible elongate element which is arranged to be wound onto a first drum by rotation of said ground wheel means when said coupling is engaged in said first mode, and a second elongate flexible element which is arranged to be wound onto the said first or another said first drum by rotation of said ground wheel means when said coupling is engaged in said second mode.

17. A land grading machine as claimed in claim 16, wherein ends of said flexible elongate elements remote from the associated first drum or drums are wound around further respective drums for transferring rotation of the or each first drum to selected ones of the said further drums when the said coupling is engaged.

18. A land grading machine as claimed in claim 17, including clutch means provided between the or each first drum and said ground wheel means whereby said coupling is engaged in said first mode by clutching one said first drum for rotation transfer from said ground wheel means and said coupling is engaged in said second mode by clutching the other said first drum for driving from said ground wheel means.

19. A land grading machine as claimed in claim 12, wherein said conveyor is formed as a length of flexible material ends of which are wound around its end rollers and secured thereto.

20. A land grading machine comprising:

a frame having support means supporting the frame for movement in a forward direction across a ground surface;

a scraper blade having a forward scraping edge and for engaging the ground surface during said movement to effect grading by scraping ground material thereonto and therepast;

a movable conveyor positioned and arranged to receive and store ground material from the scraper blade;

control means including load sensing means for sensing the build-up of accumulated scraped ground material behind said forward scraping edge; and drive means for driving the conveyor;

said control means controlling said drive means to cause the drive means to drive the conveyor to move ground material thereon in a rearward direction away from the scraper blade when the build-up of said accumulated scraped ground material reaches a first predetermined extent as sensed by said sensing means, said control means also controlling said drive means to cause the drive means to drive the conveyor to move ground material thereon in a forward direction towards the scraper blade whenever the build-up of said accumulated scraped ground material falls below a second predetermined extent as sensed by said sensing means, said second predetermined extent being less than said first predetermined extent, and to maintain the conveyor stationary when the build-up of said accumulated scraped ground material is sensed by said sensing means to be intermediate said first and second extents.

* * * * *